United States Patent [19]

Davidson

[11] Patent Number: 4,563,617

[45] Date of Patent: Jan. 7, 1986

[54] FLAT PANEL TELEVISION/DISPLAY

[76] Inventor: Allen S. Davidson, 3610 147th Pl. NE., Bellevue, Wash. 98007

[21] Appl. No.: 456,817

[22] Filed: Jan. 10, 1983

[51] Int. Cl.[4] ..... H05B 37/00

[52] U.S. Cl. ..... 315/312; 315/64; 315/313; 313/513; 313/522; 445/27

[58] Field of Search ..... 313/522, 513, 514; 340/762, 782; 315/312, 313; 445/27, 48

[56] References Cited

U.S. PATENT DOCUMENTS

| | | | |
|---|---|---|---|
| 714,233 | 11/1902 | Plancon | 313/513 |
| 1,017,263 | 2/1912 | Kitsee | 313/522 |
| 3,327,155 | 6/1967 | Mayer | 445/27 |
| 3,408,523 | 10/1968 | DeMarest et al. | 313/522 |
| 3,715,785 | 2/1973 | Brown et al. | 313/522 |
| 4,283,659 | 8/1981 | Beckerman et al. | 315/313 |

*Primary Examiner*—Harold Dixon

*Attorney, Agent, or Firm*—Townsend and Townsend

[57] ABSTRACT

A bright, economical, flat panel television/display is fabricated by laser welding incandescent metal particles together to form light emitting micro-beads, the ends of which are simultaneously welded to driving electrodes. The small physical mass and dimensions of each bead permit it to be fired to an incandescent state at high rates, becoming a controllable, bright, point source of light suitable as a picture element to create moving images. The beads are suspended between a heat resistant substrate and faceplate, both of which contain depressions proximate to each bead to provide thermal spacing and optical and thermal reflectivity to direct visible light out of the panel, and heat back to the bead, conserving power. Color filters provide full color image display in a system operating at approximately five volts, and which can be built to any size and shape. Three dimensional display capability is inherent when a plurality of transparent display panels are laminated.

42 Claims, 7 Drawing Figures

FLAT PANEL TELEVISION/DISPLAY

REFERENCES CITED U.S. PATENT DOCUMENTS

| | | |
|---|---|---|
| 454,622 | June 23, 1891 | Nikola Tesla |
| 514,170 | February 6, 1894 | Nikola Tesla |
| 3,715,785 | February 13, 1973 | Brown & Hochberg |
| 3,846,661 | November 5, 1974 | Brown & Hochberg |
| 4,063,234 | December 13, 1977 | R. M. Arn |

OTHER PUBLICATIONS

IEEE Transactions On Electron Devices, Vol. ED-20, No. 11, November 1973, "A Thin-Film Integrated Incandescent Display", by Hochberg, Seitz, and Brown.

IEEE Transactions On Electron Devices, Vol. ED-20, No. 11, November, 1973, "Performance And Design Considerations Of The Thin-Film Tungsten Matrix Display", by Alt and Pleshko.

BACKGROUND OF THE INVENTION a. Field of the Invention

The invention relates generally to electronic image displays and illumination devices, and to means for making same.

b. Prior Art

Previous light-emitting, electronic image displays have been of a wide variety of different technologies, with each suited to a limited range of uses, and no single system being suitable for most or all applications. Most light-emitting display technologies have not been bright enough to be used in full sunlight. Further, the most widely used display, the cathode ray tube, is limited to a relatively small screen size, while demand is growing for larger television displays. The CRT has the additional disadvantage of requiring a depth behind the screen approximately equal to the vertical dimension of the screen, which results in a very large, bulky, heavy system. The CRT consists of an evacuated tube with phosphor coated faceplate, which emits light when struck by a cathode ray emitted from the back of the tube. The ray scans the screen surface rapidly, creating an image in full color, and with lifelike motion. Recent CRT systems have projected the image onto an enlarged remote screen.

Other light-emitting display technologies include electroluminescent flat panels of luminescent materials which are caused to glow by application of voltage to the luminescent material. To date, brightness is too low to satisfy the marketplace.

AC gas plasma display is a flat panel envelope filled with a gas which breaks down at electrode crosspoints, causing emission of a reddish orange light.

Incandescent display panels such as U.S. Pat. Nos. 3,715,785 and 3,846,661 have demonstrated that incandescent technology has many advantages, but failed to demonstrate a truly economical, commercially practical system with televisionlike resolution. The inventors did demonstrate that an incandescent display with a great plurality of pixels can be mass produced, and is economical to operate. The present disclosure, however, teaches that filaments have disadvantages in flat panel displays, and overcomes them.

In U.S. Pat. Nos. 454,622 and 514,170 in 1891 and 1894, Tesla demonstrated a non-filament, carbon button incandescent light element wherein incandescence is caused by molecular bombardment rather than by joule heating. The button is twenty times more efficient a light producer than today's incandescent filaments, but is not used commercially due to the impractically high voltages and frequencies required to drive it.

A major object of the present invention was to devise a practical, bright, high resolution, flat panel display capable of being constructed to any dimensions and shape, and which is versatile enough to meet the needs of an almost universal range of applications.

Another major object was to devise a flat panel television/display capable of being built to any size, bright enough to be viewed in full sunlight, and with resolution potential exceeding that of high fidelity projected film images.

Yet another major object was to devise a flat panel display durable enough and bright enough for military applications.

An object of the invention was to devise an image display panel small enough to be easily portable, as for portable televisions and dynabooks.

Another object was to devise a vehicular display panel, durable and bright enough for use in vehicle instrument panels.

Yet another object was to devise a high resolution display to show computer generated data, as a computer peripheral device.

Still another object was to devise a display panel for a wide variety of office machines, such as word processors, which would have superior optical properties, be attractive to look at, and would not emit harmful radiation or be overly tiring to view for extended periods.

A further object was to devise a display suitable for creating a heads-up display system in the likes of military aircraft, commercial airliners, and automobiles.

Yet a further object was to devise bright, easily readable, electronically alterable signs or message panels.

Still a further object was to devise a lighting system suitable for thin automobile tail lamp panels.

Yet still another object was to devise a versatile flat panel architectural lighting system.

Another further object was to devise a completely transparent display panel for such uses as a map overlay.

Still another further object was to devise a display capable of displaying three dimensional images.

Yet another further object was to devise a light source for important uses such as traffic lights, which could not fail or burn out suddenly.

And yet another further object was to devise an incandescent light element which would be a point source of light, and which could be driven rapidly enough to display television-like moving images.

And still another further object was to devise a nonmechanical means to mass produce a display panel comprised of a great plurality of incandescent points of light.

And yet still another further object was to devise a display panel which operates on approximately five volts, to be compatible with standard solid-state circuitry, and use the same power supply provided therefor.

SUMMARY

The above objects have been achieved in a flat panel display and process for making same wherein a plurality of micro-bead incandescent elements are suspended in a special atmosphere between a faceplate and a substrate. When energized, the beads become bright point sources of light which are picture elements in the displayed image. The beads are so small as to have relatively little thermal inertia, and can be driven to incandescense at video rates to display moving images. The heat resistant substrate contains electrodes to which the beads are attached and suspended above a light and heat reflective surface. The optically transparent faceplate is placed above the beads and is coated with a heat reflective coating to reflect heat back to the bead to reduce power consumption, and to keep the faceplate from becoming unduly hot. Colored filters applied to the faceplate provide a colored image display. Dimensional proportioning of the beads resists physical shock and electrical burnout.

DETAILED DESCRIPTION

Figure 1:
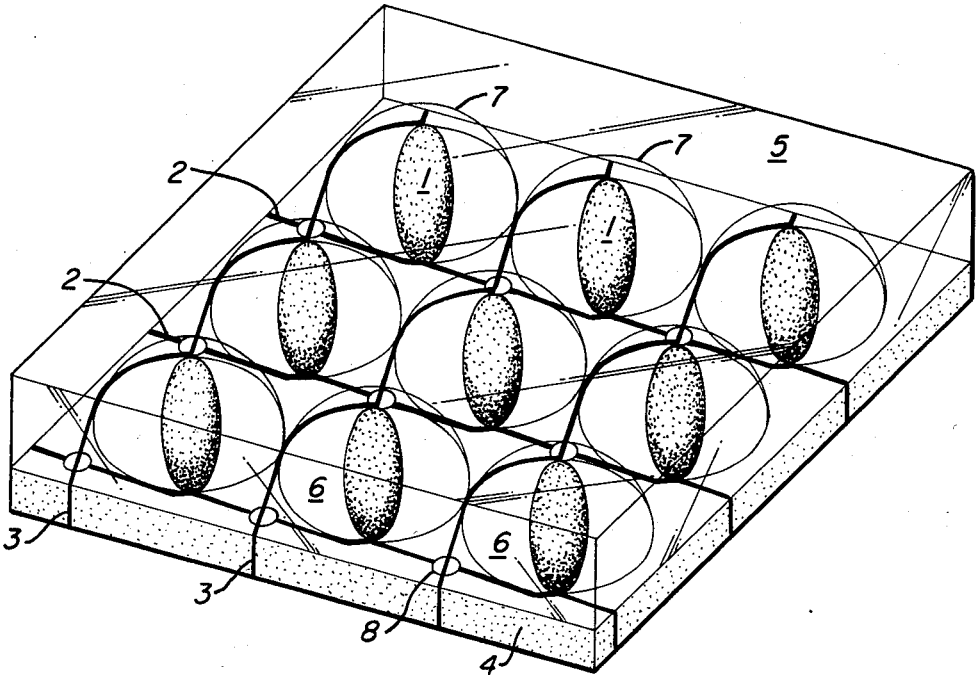
FIG. 1 is a magnified perspective view of a small display panel.

Referring to FIG. 1, the present flat panel display disclosure creates an image upon a matrix array of discrete, selectively addressable, lighted dots. Horizontal row 2 and vertical column 3 microelectrode strips are used to drive the dot pixels 1. Near each intersection where a row 2 and a column electrode 3 cross, an electrically resistant microbead 1 of incandescent material is attached in series, coupling the crossing electrodes 2,3. When a pulse of electrical current is applied to a row 2 and a column electrode 3 simultaneously, the incandescent bead 1 coupling those two electrodes 2,3 will glow for the period of the pulse. By rapidly firing selective beads 1 in the matrix at video rates, an image may be created, and said image will be capable of animated motion. As there may be well over a million individual beads 1 or pixels in an image display panel, each bead 1 must be capable of being illuminated and returned to a non-glowing state in such a brief time period that all the beads 1 in the panel may be similarly driven at a rate of approximately thirty to sixty times per second. Said current pulses in this case are sufficiently energetic to cause light emission by the addressed beads 1. Incandescence is the means used to drive the beads 1 to emit light. The physical mass of said incandescent beads 1 or particles 1 is so small that they have relatively little thermal inertia, and so can be fired to an incandescent state very quickly, and will cool to a dark state again in a similar time. Any of a wide range of incandescent substances may be used, of which tungsten is the most common.

Tungsten is an efficient electro optical substance, operating at higher luminance levels than virtually any other known material, and has the following list of applicable characteristics: It is bright enough to be easily visible in full sunlight; its broad band spectral output can be filtered to produce any color; its lifespan is not exceeded by any other light emitting substance, and can surpass 100,000 hours; it is a voltage driven electro optical transducer, consuming small amounts of power; it operates at the same low voltages as solid state integrated circuits and electronic components, so needs only one power supply for a complete system; brightness can be varied easily, permitting tonal or shading variations in displayed images, or permitting overall image brightness control to adjust for viewing throughout the ambient range from total darkness to bright sunlight; users acknowledge that incandescent light is more pleasing and attractive to look at than any other sight source, and its superior optical properties can provide a sharp, high resolution image which is precisely adjustable to make extended viewing easy on the eyes; it has good luminous efficacy, improving as the temperature is raised; it is very tolerant of ambient temperature variations, meaning it can operate in a practically unlimited thermal environment; its behavior is virtually unaffected by ambient magnetic fields, static charges, radiation, humidity, etc.; it is a very inexpensive substance and technology. Further, incandescence is a mature technology, with much proven knowledge, many experienced workers, and a great variety of existing production equipment to expedite its use, although significant improvements are revealed in the present disclosure.

Because the incandescent element 1 in the present disclosure uses a very small amount of material—only a very small percentage of the mass of a conventional filament—with very small physical dimensions, when lighted it appears as a point source of light. The incandescent element 1 may have any shape or dimensional proportions or physical nature (solid, fibrous, flake, etc.) as may be suitable for a specific design, being unlimited in this respect, but in general it shall be of the shape of a small bead, or particle, or pellet, or any small regularly or irregularly shaped mass. For convenience, this variably sized and shaped mass shall be hereinafter referred to as a "bead" 1. And although panels will be made of a plurality of beads 1, for simplicity herein, only one bead 1 will be discussed most of the time, but it is to be realized that, for the purposes of the disclosure, single beads 1, and pluralities of beads 1 are to be regarded interchangeably. Said bead 1 may have any nature surface, such as smooth, but as the luminous output of an incandescent element 1 is proportional to its surface area, if the surface area per unit mass is increased, the brightness will increase proportionally. The surface area of the mass may be enlarged, as by providing a grooved texture, a wrinkled texture, fuzzy texture, granular texture, micromountainous texture, or any of an unlimited range of types of roughened surface textures. The mass of the bead 1 may be solid, hollow, porous, fibrous, discontinuous, or any of an unlimited range of types of natures, such as the preferred embodiment of a mass of openly bonded particles. For some applications a filament element, such as is composed of a helix of wire, or a meander pattern of a metallized thin film, or the like, which is much longer than it is wide may be used. But as tungsten is a brittle material, a long filament is much more fragile and prone to physical breakage, or to notching from use, also resulting in failure, a filament-type element is contraindicated except for specific designs where it may have advantages over a bead-like element. A micro-bead-like particle 1, being rigid and able to be solidly anchored, is easy to locate precisely, and remains permanently in location, which is important to maintain focus and direction of the optical components of the present flat panel disclosure. Maintaining a precise, permanent position and being arrayed in a flat panel, means there will be zero distortion of the displayed image. Being a very small element 1 to emit a point of light means it has a short current path, which requires that the bead 1 be alloyed to create a relatively high resistance to aid incandescent operation with as small a current flow as practical. Resistance of the element 1 should be large compared to the drivers so if the impedance of the drivers varies, no variation in element 1 brightness will be discernible. Also, thermal conductivity from the bead 1 into the electrodes 2,3 or elsewhere affects light output by permitting a large portion of the incandescent energy to escape into the thermally conductive electrodes 2,3, leaving less energy to generate light. Minimizing said energy loss by making the size of the bond of the beads 1 to the electrodes 2,3 as small as possible will increase the efficiency of the panel. Said bond shall therefore be large enough to provide a permanent, secure physical attachment which will not be eroded unduly during the life of the panel, but which shall be no larger than necessary in order to minimize conducting thermal energy away from the bead 1. To maintain a uniform brightness from pixel to pixel across the surface of the display, all bead 1 parameters such as mass, dimensions, surface area, electrical resistance, and rate of thermal loss shall be as similar as practical.

Figure 2:
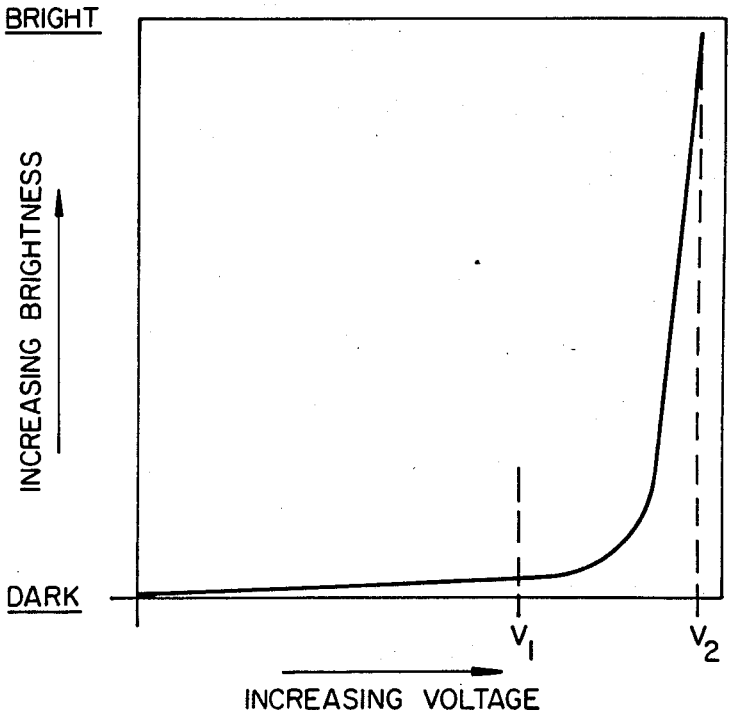
FIG. 2 is a graph showing voltage required to cause light emission, which occurs only after the threshold of the curve has been passed.

Referring now to FIG. 2, it is seen that incandescent tungsten has a further advantage of emitting light only after a threshold level of energy has been applied. FIG. 2 shows that no visible light is emitted below the knee or threshold of the curve, although some voltage V1 is applied. When more voltage V2 is added and the threshold of the curve is surpassed, visible light is produced. The threshold effect is needed so a single driver can drive all the elements 1 along one row 2 (or column 3) simultaneously. In practice, a voltage V1 below the threshold level can be applied to all the elements 1 in a row 2 (or column 3), and no light will be produced. When a small additional voltage V2 is applied to the intersecting column 3 (or row 2) electrodes, the additional voltage causes the total voltage level to surpass the threshold, moving it into an area where light is produced. A bead 1 will glow when the combined voltage from the row 2 and column electrodes 3 supplying it surpasses the threshold. All other beads 1 in the row 2 will remain dark if they do not also get additional voltage from an intersecting column electrode 3. If more voltage is applied, the total energy input rises, and the bead 1 grows brighter. As FIG. 2 shows, only a small variation in the total voltage—which is supplied by the column electrode 3—can cause a large change in brightness. Increasing the duration of the pulse will also cause the bead 1 to glow more brightly. Brightness of individual beads 1 can be controlled by varying the total voltage, or the pulse duration, or both.

Fabrication and assembly of the bead-like elements 1 may be done in any of a variety of ways such as mechanically fastening or clamping said beads 1 to the electrodes 2,3. But as a typical display panel of the present disclosure may have well over a million individual elements 1, said elements 1 must be capable of being reliably produced and attached to the panel en masse, as by the following nonmechanical manner, or similar:

The substrate panel 4 with attached electrodes 2,3 is placed level on a support, electrode 2,3 side facing up. A very finely divided powder of a suitable incandescent substance such as tungsten is spread or sprinkled onto the substrate 4, entirely covering it. Powder depth shall be as determined by the design spacing which separates the bead 1 from the substrate 4 in the completed panel, and shall be controlled by the height to which the top surface of the electrodes 2,3 extend above the substrate panel 4. Powder is very carefully removed, in a level manner, as by scraping, until the very top surface of the electrodes 2,3 is just barely revealed. Then a small diameter pulsed laser beam is applied to the top of the powder layer, tracing a short path between a row 2 and a column electrode 3, near their intersection, in the exact location where the bead 1 is desired. The energy of the laser beam, its pulse duration, and its speed of movement shall be just sufficient to melt a small mass of powder particles together as it passes over them, and weld the ends of the newly melted mass to each electrode 2,3. The laser melting operation shall be done in an inert atmosphere to protect the tungsten, and shall be done under rapid automatic control, melting and welding tungsten masses to every row 2 and column electrode 3 intersection on the panel. After the molten mass 1 has cooled and solidified, it will have been formed into a solid microbead 1, both ends of which are securely welded to the metal driving electrodes 2,3. The laser shall be controlled to melt only exactly as much powder as is desired, and to provide exactly the size welded bond between bead 1 and electrodes 2,3 as is desired. After all the beads 1 in a panel 4 are fabricated and attached in this manner, the excess unwelded particles are removed from the panel 4. Now it can be seen that the depth of the powder layer determined how far above the surface of the substrate 4 the new beads 1 would be suspended. This separation is determined by the designer to provide optimal thermal separation between the hot bead 1 and the substrate 4, and to locate the bead 1 at the desired point for best optical performance. Any size, shape, length, orientation, or variety of bead 1 or filament may be produced and attached in this manner. As long as the path, energy output, pulse timing, and speed of movement of the laser beam across the powder layer remains uniform from cycle to cycle, every bead 1 produced will be identical. Similarity among the beads 1 on the display panel provides a uniform brightness of all the beads 1. In addition to being able to control and adjust any property of beads 1 manufactured by laser fusing, it is seen that if melting is properly controlled, the newly formed bead 1 will have a very rough surface, comprised of a mass of bonded powder particles, which helps brighten the light output. The top surface where laser energy was absorbed first, will melt more thoroughly, and thus be smoother than the sides and underside of each bead 1. As brightness is determined by surface area, the smoother top surface of the bead 1, with less area, will be less bright than the sides and underside of the bead 1. But as the bead 1 is positioned above an optically reflective concavity 6, the brighter light emitted from the far sides of said bead 1 will be reflected by said concavity 6 outward from the plane of the panel 4, adding to the light emitted from the top side of the bead 1, and traveling in the same direction. By spacing each bead 1 above a reflective concavity 6, virtually the entire light output from each incandescent bead 1 will be directed outward from the front surface of the display panel. The finer the size of the powder particles used, the greater will be the surface area of the bead 1, and so the greater the efficiency.

The size of a pixel or incandescent bead 1 depends on the use to which a panel is put, which determines the distance from which it will be viewed. A display used in the likes of a word processor or an aircraft instrument panel, for instance, will be viewed from a closer distance typically than will a home television or airport information panel. Pixels/beads 1 may be larger in a display normally viewed from a greater distance, and smaller in displays typically viewed from closer. The minimum subtended angle for a pixel is approximately three minutes of arc if it is to be visible as a separate point on the display. But an image display may be comprised of a plurality of pixels which are too small to be distinguished separately, but which cumulatively create an image. Other displays may use relatively few pixels to create an image, which is of a coarser dot matrix nature. Therefore, pixel size is to be determined by the use to which the display panel is put. Pixel size is determined by the size and brightness of the bead 1, the size of the underlying reflector 6, and the size of the filter means 10. Physical size of the incandescent bead element 1 can be a small fraction of the end pixel size. In a display using discrete color filters 10 over each lighted point 1, the color filter 10, if translucent, will hide the bead 1 and appear to be emitting the light itself. Transparent filters 10 exhibit this effect to a lesser degree than translucent filters 10, but still increase the apparent pixel size. Also, light reflected from the concave depression 6 will apparently light up the area of the depression 6, causing it to help determine pixel size. Pixel size therefore, results from the light reflecting from the depression 6 area and illuminating the area of the color filter 10 more than from the size of the bead 1 itself. A small lighted bead 1 can increase its apparent size just by increasing its brightness. So although a bead 1 the size of a grain of sand is too small to be seen at a distance of several feet, by illuminating brightly, it becomes visible, and by illuminating more brightly seems to become larger. An unusually wide range of display uses is served by the present invention because its pixel size and brightness can be adjusted widely.

That brightness may alter pixel size in the present disclosure can help minimize or eliminate a problem which occurs in images composed on a matrix array of dots. Displayed lines or edges such as curves or diagonals typically exhibit a stepped, sawtooth nature which detracts from the appearance of a feature which should appear smooth. If desired and the application permits, the jagged steps arrayed in such curves or diagonals, etc. can be softened or reduced by increasing the brightness of the pixels. For when brightness is raised, the apparent visible diameter of a pixel increases, and its edge softens as perceived by the eye. With a softer edge, the stepped effect reduces and smooths out to a degree. Additionally, a line comprised of an array of very bright dots will fool the eye due to its brightness and appear to be a smooth, continuous line. The foregoing are two separate effects by which the present invention can show better image quality.

Although a great many varieties of displays are used for digital messages with relatively low resolution, other image displays require very high resolution. Image display resolution is easily adjusted by varying the interpixel spacing. Pixel spacing of the present invention can be varied to accommodate the entire range of uses, from very wide spacing to spacing so tight that image quality can exceed high fidelity projected film images.

The incandescent element 1, being a small, bead-like shape having a short, relatively thick, unsupported length is tough and resistant to breakage and burnout. Filaments may be used in the present disclosure, and made by the present method, but tungsten is a brittle material rather poorly suited to being used in long filaments (but used extensively in exactly that way in other applications) which may be subjected to rough handling. Certain applications of the present disclosure, such as military and automotive displays, etc., require resistance to severe physical shocks. The small, tough, bead-like element 1 meets those requirements while also meeting all the requirements for light generation, and so is the preferred embodiment.

Figure 3:
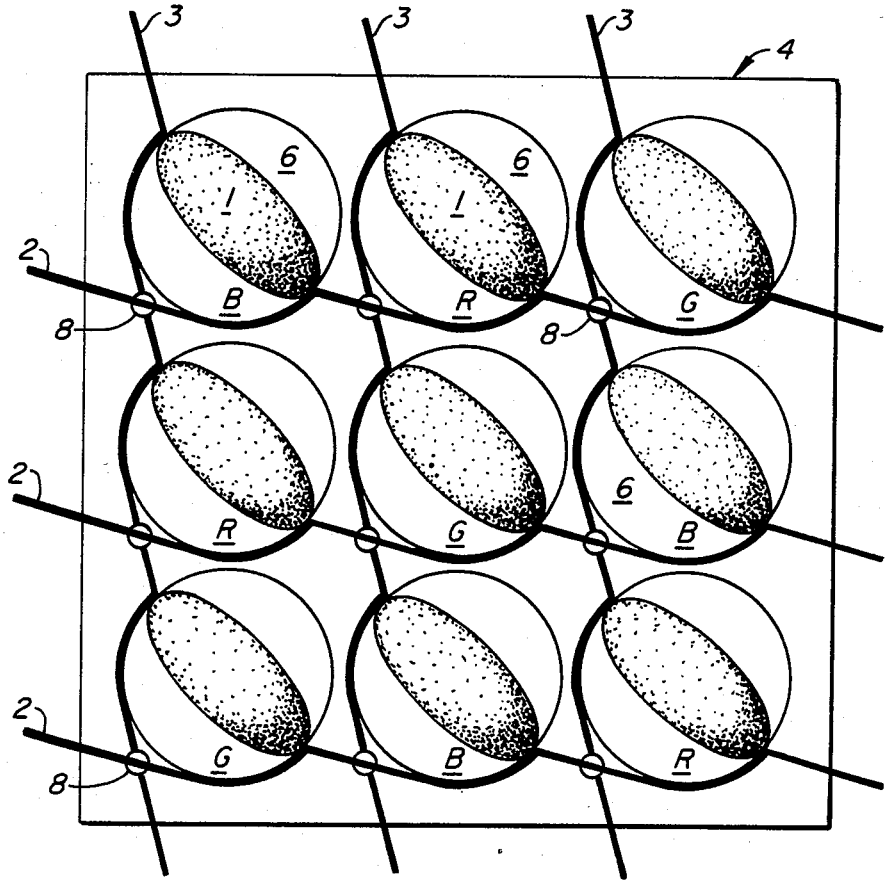
FIG. 3 is a magnified plan view showing row and column electrode circuitry, separated by insulators, and to which beads are attached.
Figure 4:
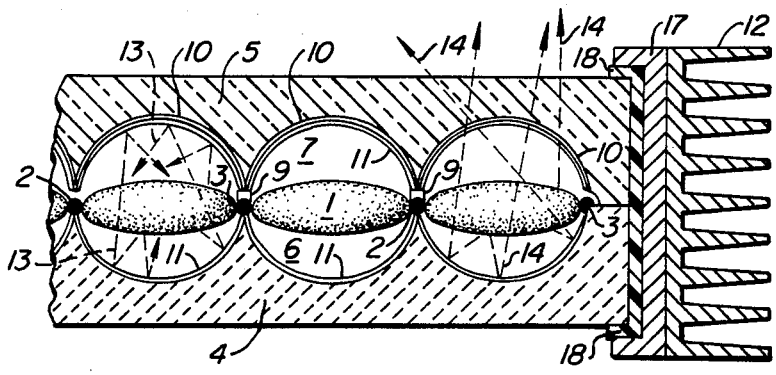
FIG. 4 is a magnified section view cut through the faceplate and substrate showing the depressions, beads, coatings, radiation, and frame.
Figure 5A:
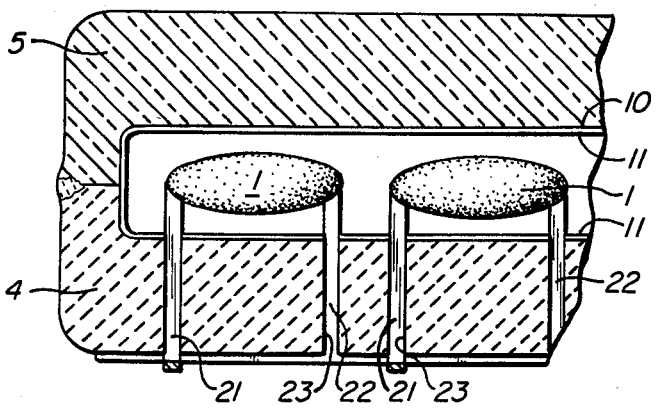
FIGS. 5A and 5B is a magnified section showing two varieties of panels with electrodes penetrating the substrate, and with faceplate and substrate welded to each other.
Figure 5B:
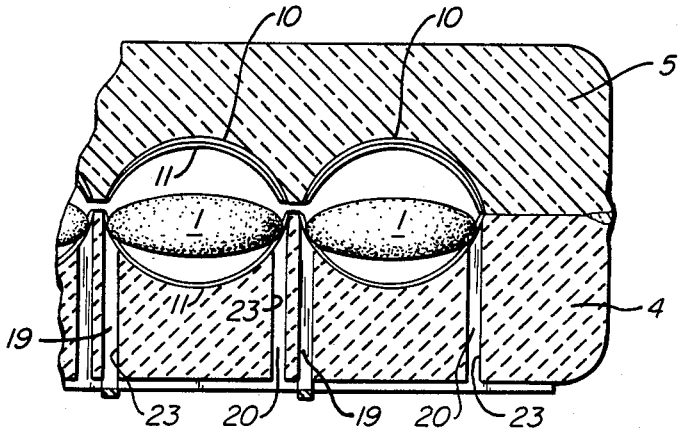

FIG. 3 shows electrodes 2,3 arrayed as rows 2 and columns 3 on substrate 4. FIGS. 5A AND 5B is a section view showing electrodes 19,20,21,22, which are arrayed in similar row and column fashion on the back of the substrate (not shown), with the electrodes 19, 20, 21, 22 penetrating the substrate through vias 23 to the front surface. FIGS. 5A and 5B illustrates two alternate designs where electrodes 21, 22 extend above the substrate 4 surface as posts, contacting bead 1, which is attached to the electrode post 21, 22 ends and held at the proper distance above substrate 4 surface. Electrodes 19, 20 penetrate the substrate in the same way, but halt flush with the substrate 4 surface, preferrably on the slope of the depressions 6. Bead 1 attached to electrodes 19, 20 is held above substrate 4 surface due to the concave depression 6 dropping away between the electrode 19,20 ends. Exact design of the driving electrodes 2,3 is not critical to the present disclosure as long as they attach to every light emitting element 1 in the described fashion, meaning many design variations are possible.

Generally the electrodes 2,3 are applied to the inner surface of the substrate 4 in a pattern similar to that shown in FIG. 3, with the electrodes 2,3 running along the borders of the depressions 6. Electrode strips 2,3 are any suitable conductive material such as copper, and are applied to the substrate 4 by any of a variety of known means. Provided the substrate 4 is an electrically nonconductive material, such as it normally is, no insulation is required between the electrodes 2,3 and it 4. The electrodes 3 running in one direction are applied first, the insulation 8 is applied to every point where the subsequent electrode 2 array will cross, then the other electrode 2 array is applied. Connection of the bead 1 in the proper location over a depression 6 is made easier if the two electrode arrays 2,3 run at an acute angle relative to each other. The resulting grid of electrode strips 2,3 will surround each depression 6, inside of which the surface drops away from the electrodes 2,3 so the bead 1 can attach between two electrodes 2,3 and be suspended above the concave area 6, in free space. The bead 1 will be approximately centered in each depression 6, a suitable distance above it. This provides for an optimum thermal spacing between the hot bead 1 and the substrate 4, preventing said substrate 4 from being unduly heated. Configuration of the depression 6 places the bead 1 at its focal point, so light 14 emitted by the bead 1 will be reflected by the curved surface 6 and directed outward from the plane of the substrate 4. Said depressions 6, if used, may be similar in shape no matter which of the electrode 2–3, 19–20, 21–22 designs are used. The concave depressions 6 are preferred to aid efficient functioning of the display, but are not mandatory. If desired, the substrate 4 and faceplate 5 may have simple, flat surfaces, as shown in FIG. 5(A). Similarly, many design variations are possible for the electrodes 2,3, but the generally preferred embodiment is that illustrated in FIG. 1.

Figure 6:
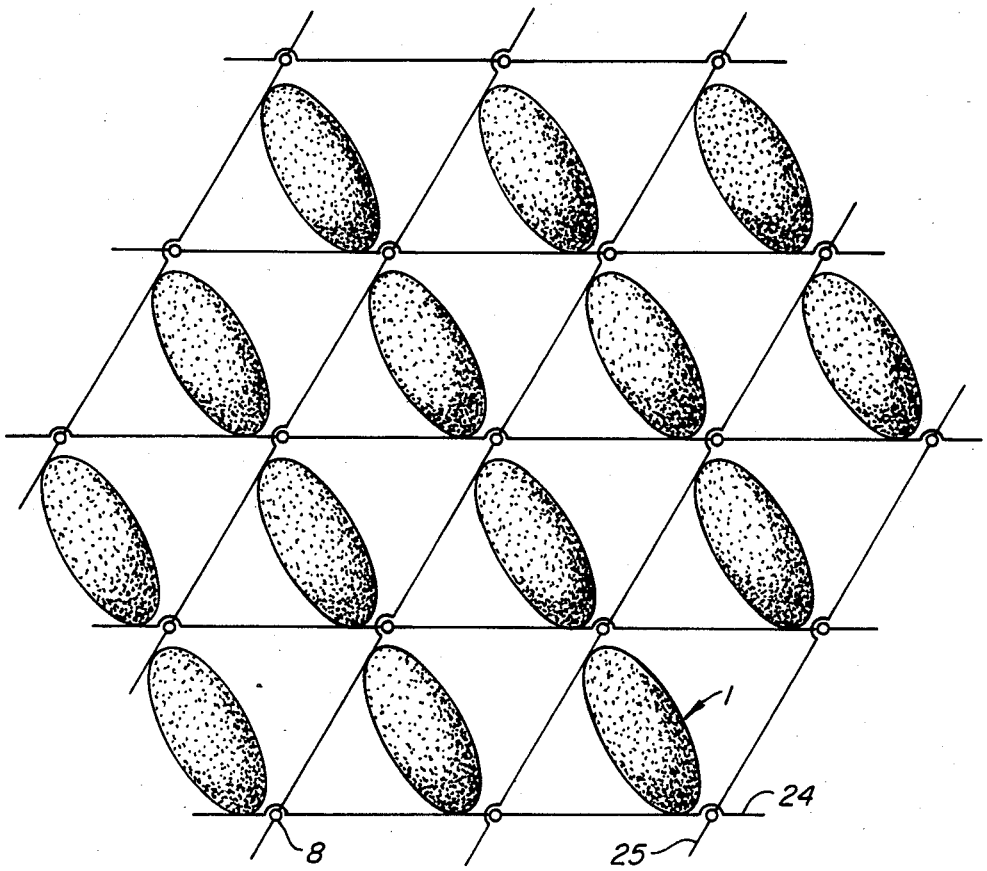
FIG. 6 is an independent wire mesh electrode assembly with incandescent beads attached in mesh openings, and showing interelectrode insulators.

Another alternate electrode system is illustrated in FIG. 6. This electrode 24,25 array is an independent assembly constructed of wire mesh with electrical insulators 8 applied between every wire 24,25 crosspoint. This insulation 8 may also be a material such as heat resistant porcelain applied continuously to both wires 24,25, or to only one as mutual insulation, and removed therefrom only at the points where the beads 1 are attached. The wire 24,25 mesh assembly complicates the optical performance of the panel, but can be improved slightly if such as a white, optically reflective porcelain type coating is applied to the wires. Use of depressions 6,7 in faceplate 5 or substrate 4 is optional. An infra red reflective coating is suggested for application continuously over the surface of the porcelain, or wires 24,25 in order to minimize heat absorption. The wire 24,25 mesh is sized so that when attached to driving circuitry and placed atop the substrate 4, the openings in the mesh 24,25 will correspond with the locations of the depressions 6,7 in the panels 4,5 above and below it, if said depressions 6,7 are used. Beadlike light elements 1 are attached to the wire 24,25 grid by covering the grid 24,25 with a layer of finely divided powder of an incandescent substance such as tungsten, and scraping away the powder until the tops of all the wires 24,25 are visible in the powder. Slightly more powder is removed here than in the previous example, as the bead 1 is desired to be placed lower, or more deeply inside the wire 24,25 mesh, rather than even with the top surface thereof. A pulsed laser beam is applied to each mesh area unit in the mesh 24,25 with the laser tracing a path from row wire 24 to column wire 25. The laser's energy output, path, rate of travel, and pulse timing are just sufficient to melt the desired amount of particles together into a bead 1 and to weld the ends of the newly created bead 1 to a row 24, and a column electrode 25. The new bead 1 will be located approximately centered in each opening of the wire mesh 24,25. Where the laser beam first contacted the powder, the top surface thereof will be melted more than the other surfaces, so said top surface will be smoother than the other surfaces. As the rougher undersurfaces of the new beads 1 will be brighter than the smoother top surfaces, the bottom side of the wire 24,25 mesh assembly will be the brighter. Consequently, when the wire mesh 24,25 bead 1 panel is placed atop the substrate 4, it should be placed with the brightest side facing up. With wire 24,25 grid/bead 1 panel precisely positioned on the substrate 4, wiring contacts are made between each electrode 24,25 in the array and the display system's driving circuitry, with said wiring 24,25 being heat sunk 12 between said two components. Then the faceplate 5 is placed over the wire grid 24,25 and positioned so its depressions 7, if any, correspond to the bead 1 locations. Subsequently, all the panels 4,5, (1,24,25) are fastened together as described hereinafter.

As thermal conduction from beads 1 into electrodes 2,3, 19,20,21,22,24,25 is a factor affecting system power consumption, and as the electrode grid 24,25 design shown in FIG. 6 is not physically printed or painted onto the substrate 4, it will remove less heat from the beads 1 than will electrodes 2,3,19,20,21,22 which are printed onto the substrate 4, and which provide an excellent thermal path from bead 1 into substrate 4 due to this attachment. The electrode 24,25 grid will, however, hinder light output unless the wires 24,25 are carefully shaped to contours suited to reflect light 14 from the bead 1.

The display panel substrate 4 is comprised of a heat resistant substance which is a non-conductor of electricity, such as glass, ceramic, porcelainized steel, or any similar material. Said substrate 4 is generally of a flat, rectangular shape, although any configuration may be used without limit. Thickness is adequate to provide a rigid, sturdy, durable support for the lighted display elements 1, which in some applications may be subjected to rough, physical forces. The substrate 4 and display may be structurally reinforced by any of a variety of known means such as embedded fibers, molded-in framework, a separate embedded framework, or an attached structural framework, or the like. The panel 4 can be generally of a flat nature, with both sides being smooth and flat, but will offer improved performance if the interior surface contains an array of small depressions 6. The depressions 6 are located centered under each bead 1, and shaped to perform as a reflector, directing radiation 13, 14 from the bead as described elsewhere herein. Surface depressions 6 may be created by any known means, such as by molding when the panel 4 is created, or by laser vaporization after the panel has been made, etc. The arrangement pattern of the depressions 6 shall correspond to the pattern of beads 1 which illuminate the display, and may be arranged in any pattern, such as that shown in FIG. 1. Individual beads 1 are mounted suspended at the center of each depression 6, and spaced at a design distance sufficient to prevent overheating of the substrate 4 by the hot bead 1. However, in displays containing the tungsten-halogen incandescent system, bead 1 spacing shall provide a substrate 4 surface temperature of at least 250 degrees centigrade. The tungsten-halogen process is well known to those in the art as a means for removing the darkening coating of tungsten particles deposited on the interior envelope surfaces and returning the tungsten to the incandescent element 1 from which it came. It is a cleaning process for incandescent systems which maintains over 90% of the optical output of the display throughout its life.

The substrate 4 material is preferably of a light and heat reflective color. And it may be coated with an optically transparent, infra red reflective substance 11, such as that developed by MIT/NSF for reflecting heat in incandescent lamps back to the filament, providing an energy saving of about 60%. The heat reflector 11 serves to reflect heat 13 before it can be absorbed by the substrate 4 mass. Heat 13 reflects from the substrate 4 to the faceplate 5, from which it is reflected again, back to the element 1 from which it came. Temperature of the bead 1 is thus maintained with a smaller energy loss, raising the system's efficiency. The IR reflective coating 11 may also be any other IR reflector, such as a thin coating of metallized gold, but since most IR reflective materials may be electrical conductors, spacing or insulation means should be used between them and all electrical circuits and conductors in the display.

In addition to reflecting IR 13 to diminish its absorption into the substrate 4, the substrate 4 material should have as low a rate of thermal conductivity as practical, to be an effective heat insulator to keep the heat inside the envelope where it aids system performance. Conducted thermal energy is encountered mainly at the points where the beads 1 attach to their driving electrodes 2,3,19,20,21,22,24,25. The electrodes 2,3,19,20,21,22 conduct heat away from the bead 1 and along the electrode 2,3, 19,20, 21,22 which may be continuously bonded to the substrate 4, aiding heat transfer from the electrode 2,3,19,20,21,22 into the substrate 4. Heat conduction from the bead 1 can be minimized by reducing the size of the connecting weld or attachment of the bead 1 to the electrode 2,3,19,20,21,22,24, 25. The connecting weld should thus be as small as practical to reduce energy loss, while providing a fail-safe physical and electrical connection. Heat loss will also be reduced if the electrode 2,3,19,20,21,22,24,25 is permitted to remain heated. However this heat must be removed from the electrode 2,3,19,20,21,22,24,25 before it reaches the driving electronic components, necessitating a heat sink 12 in front of said electronics. Heated conductors 2,3,19,20,21,22,24,25 will increase the resistance in said conductor 2,3,19,20,21,22, 24,25 and this must be accommodated for in the system. Heat sink means 12 are attached to the conductors 2,3,19,20,21,22, 24,25 to remove heat therefrom. As the electrical conductors 2,3,19,20,21,22,24,25 are normally not insulated, heat sinks 12 should be either non-electrically conducting materials such as plastics or ceramics, or if they are electrically conductive, must be electrically insulated therefrom, as by a layer of heat conductive plastic film or grease. Heat sink means 12 may be placed at any location, of which the panel 4,5 edges and rear panel 4 surface seem the most suitable. Heat sink means 12 may also be attached directly to the substrate 4 mass to remove excess heat therefrom. Heat sink 12 attachment means must allow for a possible difference in the rate of thermal expansion of the heat sink 12 and the substrate 4, as widely varying rates may unduly stress and damage either or both if solidly attached to each other. Attachment of said two components 4,12 shall thus allow a small relative motion, while maintaining good thermal conductivity therebetween.

If temperature limits for the display are unusually restrictive, heat removal may be aided by forced air circulation or by use of a liquid cooling medium. Alternatively, other heat removal means may be used, such as cooling pipes or tubes, heat pipes, a refrigeration system, or the system may be in a layered configuration containing a stratum of cooling liquid or gas inside the substrate 4. Cooling means may be located remotely instead of mounted to the panel, if desired. If the substrate 4 is made of a material such as glass or ceramic, with the front surface layer preferably comprised of a thermally insulating formulation, another layer of the same kind of material—glass or ceramic—may be molded or laminated to the back surface of the front layer, but said second layer may be of a heat conductive formulation, and may be molded or configured so as to contain heat sink fins or the like. If such a lamination is used, the laminated materials must have closely similar thermal coefficients of expansion, or undue bending of the panel may occur during heating and/or cooling. The heat sink means 12 may also be the framework 17 which attaches and holds the faceplate 5 and substrate 4 together, and/or may be such as the structurally reinforcing members, or the like.

In addition to having a reflective bowl 6 configuration, the substrate depressions' 6 edges should preferably rise to at least the same elevation as the top of each bead 1. Forming a partition around each bead 1 prevents light from neighboring pixels from interfering with each other. Relatively deep concave depressions 6 are the same as extending the partitions above the beads 1, if the beads 1 are sunk deeply into the depressions 6. If each bead 1 is sunk into its depression 6, its light 14 is restricted to only its own pixel.

To reinforce the substrate 4 and faceplate 5 panels against impact forces, and against air pressure if the envelope 4,5 contains a rarified gas or vacuum, to prevent the envelope's 4,5 collapse, a spacer means 9 shall be used to maintain the design spacing of the substrate 4 and faceplate 5 panels. Said spacer means 9 shall be as small and inconspicuous as possible to avoid interfering with the display optics. Said spacer means 9 may be anything such as small, independent pegs which are placed at intervals about the mating surfaces of the two panels 4,5. Or they 9 may be small peg-like moldings protruding from either or both panels 4,5. Or the spacer 9 may be the wire grid electrode system 24,25, which uses the wires 24,25 as spacer means. But using the grid 24,25 itself as the spacer 9 will permit undue amounts of heat to be conducted from the grid 24,25 into the faceplate 5 and substrate 4, and so it is preferred that said grid 24,25 have other spacer means 9 attached to it which will help thermally separate and insulate it while providing spacing for the two panels 4,5. Spacer means 9 may be either hard rigid substances or a firmly compressible, rubbery type cushioning material, of which a large variety exist. Such a material must give off no contaminating outgassing. To additionally reinforce both the substrate 4 and faceplate 5 and possibly permit them to be produced from a thinner sheet of material, the spacer means 9 may be welded or glued or otherwise physically attached to both panels 4,5. Spacers 9 may also be any other suitable means, such as partitions, strips, wires, posts, hoheycomb panels, etc.

The faceplate 5 is a transparent, heat resistant, sheet material such as glass or quartz, but not limited thereto, through which the display elements 1 are viewed. The faceplate 5 is securely attached around its perimeter in an airtight manner to the substrate 4, forming a hollow envelope to maintain the special atmosphere surrounding the incandescent elements 1. The faceplate 5 may generally be as smooth and flat as polished plate glass, although it may have a matte, non-reflective outer surface, or may be any configuration other than flat. The interior surface may be smooth and flat, but preferably shall be covered with a plurality of small concave depressions 7 in a matrix array corresponding to the pattern of incandescent beads 1. Each depression 7 shall be located centered over a bead 1. The concave depressions 7 serve to provide thermal reflectivity and an optimum thermal spacing between the hot, incandescent bead 1 and the faceplate 5, to prevent overheating of the faceplate 5. But if a halogen gas atmosphere is used surrounding tungsten beads 1, the spacing shall be close enough to assure that the surface of the faceplate 5 will reach a hot enough temperature that the well known tungsten-halogen process will operate, to keep the interior surface clean.

The faceplate 5 should be a fairly good heat conductor to avoid undue thermal stress by rapidly spreading out the absorbed heat when heated unevenly by the sometimes non-uniform display image.

An area, generally the approximate surface area of each depression 7 may be coated with color filter means 10 to color the light 14 emitted by the bead 1. Said filters 10 may be of any desired color. To provide a full color television-like display, the colors normally used are red, green, and blue, and are arranged as illustrated in FIG. 3 with the pattern being marked by R,G,B, the abbreviations for those three colors. But other displays may use any other desired colors, patterned as the designer sees fit. Filters 10 may be either transparent or translucent. Transparent filters 10 permit the lighted bead 1 to be seen through them as a colored point of light, and generally provide a more brilliant, sparkling display appearance. Translucent filters 10 hide the glowing bead 1 itself and appear to be emitting the light themselves, as a somewhat softer light source. Any degree of transparency-translucency may be intermixed to achieve the desired optical effect. Translucent filters 10 block a greater portion of the light than do transparent filters 10, and so may appear dimmer, but with such a bright display, this is a trivial effect. Color filter means 10 may be applied to either surface of the faceplate 5, to both surfaces, or laminated between the surfaces, and may cover either discrete areas such as each depression, or may cover larger areas continuously. When discrete area filters 10 are used, in order to provide wide angle viewability, the filter 10 must cover each lighted point, even when viewed from an extreme side angle. This requirement is simplified if the filter 10 is applied to the interior surface of the faceplate 5, covering at least the entire surface of each depressed area 7, and possibly a little more. If the bead 1 is recessed at least partially into the depression 7, wide angle viewability through the filter 10 is assured.

The filter 10 material should be of a heat resistant nature which will not change color, delaminate, or otherwise change when subjected to thermal effects for long periods. Although it may be a coating which adheres to the faceplate 5 surface, the preferred embodiment is a stain which penetrates into the faceplate 5, rather than being a coating applied, which may alter the precise contours of the depressions 7, and/or may be subject to delamination. A penetrating stain will not alter the surface contours, and can not delaminate.

Overlying the colored filter 10 and the entire inner surface of the faceplate 5 is a continuous coating of an optically transparent, heat reflective coating 11. This coating 11 may be of the type developed by Massachusetts Institute of Technology and the National Science Foundation to reflect infra red energy emitted by incandescent filaments, to direct that energy back to the filament to reduce its energy consumption by approximately 60%. When applied to the surface of the depression 7, it 11 reflects IR radiation 13 back to the bead 1 from which it came. By coating the entire surface of the faceplate 5, most heat 13 is reflected before it can reach the faceplate 5 mass and be absorbed, heating the faceplate 5.

The faceplate 5 is a portion of a hollow, airtight envelope 4,5 which may contain a vacuum, a rarified inert gas, halogen gas, or other atmosphere normally held at less than ambient air pressure. Consequently, air pressure outside the envelope 4,5 will normally exert a force attempting to collapse the evacuated envelope 4,5. At selective locations spaced about the area of the display panel, between the faceplate 5 and substrate 4, there shall be placed spacer means 9 to resist external compressive forces and help maintain the design spacing of the two panels 4,5. The spacers 9 may be small peg-like devices molded to the interior surfaces of the faceplate 5 and/or substrate 4, or be independent devices placed therebetween. Size and location of spacer means 9 shall be adequate to avoid optical interference with the pixels. Horizontal separation of said spacers 9 shall be determined by the thickness and strength of the two supported panels 4,5, and shall generally be spaced equidistant about the surfaces of the mating panels 4,5. Said spacer means 9 also provide structural support to aid resistance to damage by the likes of impacts, blows, etc.

The faceplate 5 and substrate 4 are attached to each other around their mutual perimeter in an airtight fashion. If the two panels 4,5 are comprised of the same material, such as glass, or of different materials with very closely similar rates of thermal coefficient of expansion, the two panels 4,5 may be physically welded to each other, as by heat or an adhesive system. But if the panels 4,5 have different expansion rates (or even if they do not), they may be attached using a separate framework 17 containing a permanently airtight, heat resistant gasket means 18. This frame 17 will permit small relative movements of the two panels 4,5 sufficient to prevent undue stressing of the members 4,5 by thermal expansion forces. Attachment by frame means 17 can be done using flat panels 4,5, whereas if the panels 4,5 are welded directly together, the edges of one or both may have to have a lip or folded edge to form a shallow open box or dish shape configuration to provide spacing between the two panels 4,5. Or a third piece may be welded around the perimeter, sealing them together.

If desired, the faceplate 5 and substrate 4 assembly, with beads 1 sandwiched therebetween need not be sealed together as an airtight envelope, but may be attached to each other and inserted into a separate container, which may be sealed airtight, and through which the display image may be seen. Encapsulation inside such a separate envelope will help restrict heat transmission from the bead 1/faceplate 5/substrate 4 assembly to the envelope 45 containing it, keeping the outer surface thereof cooler.

It is a very significant part of the present disclosure to attempt to correct a widespread error in the display field wherein a monochromatic, colored, lighted display will use a colored faceplate or filter the same color as the lighted display elements in an attempt to increase contrast. But under very bright ambient light, a colored filter appears to "self illuminate", and the creation of this surround lighting the same color as the display lights causes readability to drop sharply. Similarly, non-reflective etched faceplate surfaces or coatings "self illuminate" under bright ambient lighting, causing the surface to light up sufficiently to seriously reduce readability of the display. These two factors are mentioned only because they are so common, and in an attempt to prevent their use in this invention. But depending on the specific application and nature of displayed images, the preceding may be favored for certain specific uses, but generally are contraindicated. In the present disclosure, reflectivity is not generally a problem, as an image can only be reflected on a polished faceplate 5 if the reflected light is brighter than the light behind the faceplate 5. As the present invention's brightness can be so great, this may almost never happen, except in unlighted portions of the display. No means are needed to increase contrast ratio since the lighted elements 1 are so bright. Consequently, a perfectly clear, untinted faceplate 5 may be used. However, under bright ambient lighting, the discrete color filters 10, if used, may appear to self-illuminate on unlighted areas of the display. To counteract this, and to provide a black background for the displayed image, a black or gray tinted faceplate 5 may be used over the color filters 10. In bright ambient lighting, the black or gray tint of the faceplate may appear to "self illuminate" as previously described. But in doing so, its own color will be made more prominent, meaning under bright ambient lighting, the faceplate 5 will appear very dark, or black. This will increase the contrast ratio because regions surrounding illuminated beads 1 will appear very black. Such a dark tinted faceplate 5 will dim the light 14 reaching the observer, but with such a bright display, this effect is trivial, and can be totally overcome if desired, by simply increasing the brightness. A black or gray tint will not alter the colors being transmitted through it. A black or dark gray faceplate 5 with a polished surface may have an advantage, for instance when used as a home television, of appearing as an attractive, reflective black mirror when not in use. However, a black faceplate 5, being dark, will also reflect unwanted lights during use, on areas of the screen which are not lighted temporarily, and so should be treated anti-reflectively.

The faceplate 5 may have a plastic film laminated to the surface, or in a sandwiched faceplate 5 to increase shatter resistance. To keep the outer surface of the faceplate 5 cool, a plurality of spaced faceplates 5 may be used, thermally insulating them from each other to reduce heat transfer. Cooling air may be allowed or forced to circulate between faceplate 5 layers, and/or the inner surface of each layer may be coated with the aforementioned infra red reflective coating 11. If surface temperature requirements are unusually restrictive, a liquid cooling medium may be circulated between the layers.

For certain applications, one of the electrode arrays 2,3 may be applied to the inner surface of the faceplate 5. These electrode strips 2,3 may be either very thin metallic strips, applied so finely as to be almost imperceptible, or they may be of an optically transparent material, of which more than one exists. Incandescent beads 1 may be attached to them by any customary means, of which the simplest may be to use physical pressure of two panels 5 to secure the beads 1 in place therebetween. Or, if sandwiched between the faceplate 5 and a transparent substrate 4, the entire display becomes totally transparent. Such a totally transparent display is usable for such as a heads-up display in aircraft, or for transparent sign panels placed in windows, etc.

To create a three dimensional display, or any variety of display requiring a plurality of lighted display layers, incandescent elements 1 may be sandwiched between each of a plurality of transparent panels (similar to 4 and 5), to create a multiple-layered display. Row 2 and column 3 electrodes are placed on opposite faces of the transparent panel layers, so that when two panels are laminated, the two opposite electrodes 2,3 come together, contacting the beads 1 between them. As many layers as desired may be laminated. In this assembly, the transparent layers may be of very thin sheet stock so the beads can be relatively close together in the vertical direction. The electrode strips 2,3 may be extremely fine strips of conductive metal, such as is used in the other versions, but when many layers are used, these finely visible strips 2,3 will tend to obscure the image cumulatively. Transparent electrodes 2,3 are therefore recommended, which will not unduly interfere with visibility of the lighted beads 1, even though many layers may be used. Such a three dimensional display creates images in a true basrelief fashion, not in an illusionary fashion, and so requires no special glasses or viewing aids. The deeper the panel, and the more layers, the more realistic will be the three dimensional effect. Three dimensional images can convey much more easily perceptible information, which may be important in such uses as a military aircraft heads-up display panel, to enable a quicker response. The aforementioned three dimensional displays may be totally transparent so they may be viewed through, although such a plurality of elements will restrict vision to a degree. A non-transparent three dimensional display is made simply using the opaque substrate panel 4 mentioned previously. In a transparent display panel of either type, the heat sinks 12 will be placed preferably around the perimeter of the panel.

When used as a heads-up display, a transparent display which can be viewed through may be placed in the window area. Or a non-transparent display may be layed approximately horizontally and the brightness raised so high that its displayed image will be reflected in either the windshield or a flat, transparent viewscreen placed before the windshield. The display light elements 1 are capable of sufficient brightness to be visible even when viewed in the direction of the sun, and can also display colors which will not interfere with a dark-adapted human eye. In this use, brightness is easily controllable so that it provides the proper balance and can be viewed through without overpowering the scene on the other side of the display. Moving the display through unusual environmental effects, as may be encountered in war, such as powerful magnetic fields, electrostatic fields, radiation, or humidity, and the like should have virtually no effect on the functioning of the display instrument. The failsafe nature of the display, provided by a plurality of independently addressable light elements 1 helps assure that it will operate under the most unfavorable circumstances.

Panels of the present disclosure of any size and shape may be used for providing light in such as architectural uses. The primary function will be as a light emitting panel, in which an image display capability may either be included or omitted. Color filters 10 may be included so either the entire panel or a portion thereof may change color to emit any desired color of light 14. Brightness may be varied either by varying the energy supplied to each bead 1, or by illuminating a greater or lesser portion of the beads 1.

Illumination panels for such uses as automobile tail lamps and parking lights are also possible with the present disclosure. Rather than being restricted to only flat and rectangular configurations, any shape or contour panel may be created, for instance, to fit against auto body panels of any type curvature. Such a lamp avoids having to cut holes in body panels to be installed. Brightness of such auto lamps may be varied either by supplying a variable voltage to the beads 1, or by firing a greater or lesser portion of the beads 1 in a panel. Image display capability may be included or omitted, but display of certain images, as a moving arrow to indicate direction of a turn, has advantages. The further advantage that illumination panels of the present invention virtually cannot fail suddenly, as can other single filament element lamps, is especially valuable in automotive uses. The illumination panel can be designed to use the same voltage as an automobile's power system supplies. Possibly a porcelain coated steel substrate panel 4 may be used rather than ceramic or glass, to offer better resistance to road shocks and vibrations.

The present disclosure can also be tailored as any kind of illumination device which must not fail suddenly. Size and proportions of the incandescent beads 1 makes them resistant to electrical burnout and to failure from physical shock. Also, with a great plurality of light emitting elements 1 in a panel, possible failure of a few will hardly be noticed, and total sudden failure of an entire panel is virtually prevented. For important uses such as traffic lights and warning sign lights where failsafe operation and great brightness levels are necessary, the present invention offers advantages.

The display panel of the present invention shall preferably be manufactured as a single, continuous piece, but if the overall size is too large to be practical as a single piece, the panel may be manufactured in segments of a more convenient size. Panels too large to ship safely, too large to pass through doorways, or larger than available sizes of pre-manufactured sheets of faceplate 5 and/or substrate 4 material, etc. may be more wisely manufactured in segments. A primary consideration is that the seams of segmented display panels must be made as finely and as tightly and as imperceptibly as possible. And picture elements must be placed right up to this edge, as closely as possible. Means for attaching panel segments together may be of almost any variety of common clamping or attachment devices. The display's electrode array 2,3 will require connections so the segmented display may function as a single monolithic panel when attached. All other components of the system will be designed to function with a segmented display similarly to in a monolithic display. A surrounding frame means 17 will be important, to provide structural reinforcement, support, and anchorage for unusually large display panels, as well as to help attach segments together rigidly.

A frame means 17 may be used, surrounding the perimeter of the display in much the same manner as a picture frame is used. Said frame 17 may be used to fasten the substrate 4 and faceplate 5 to each other, using heat resistant gasket means 18, if the substrate 4 and faceplate 5 are not sealed by another technique. Said frame 17 may also serve to structurally reinforce the display panel. And it 17 may also contain means to mount the display to its point of use. The frame 17 may also serve as a heat sink 12 for the faceplate 5, the substrate 4, and the electrode conductors 2,3. It 17 may also serve as a housing for the drive circuitry components, which serves the added advantage of decreasing the length of the electrode conductors 2,3 required between the display elements 1 and said drive components. A frame 17 may also serve an important decorative design function, similar to a picture frame. And can also function as the attachment points for decorative and/or protective doors, which may cover the display panel when not in use.

Since image brightness may far exceed that of other image display devices, the present disclosure permits the fabrication of an image display which may be made to any size, and display any brightness image, for use by near-blind people, who require very large or very bright images to see.

The display device of the present disclosure emits no harmful radiation, such as X-rays.

Faceplate 5 may have any of a variety of special optical surfaces, such as fresnel lense or the like, to optically treat the light being transmitted through the faceplate 5 to accomplish any of a number of special purposes, such as to cause the individual pixel grains to blend together into a smoother, grainless image, etc.

An alternate method of making and attaching light elements 1 from the incandescent powder covering the electrodes 2,3 is to apply charge pulses selectively to row 2 and column 3 electrodes which address the point where an element 1 is desired. The charge will flow from one electrode, a row electrode 2 for instance, to the other electrode, the column electrode 3. The current pulse timing and energy are sufficient to quickly melt together the metal particles through which it flows. The ends of the newly welded mass 1 will also weld to the electrodes 2,3 supplying the welding energy. Only the electrodes 2,3 supplying the pulse to a location will be charged, all others will float. The energized electrodes 2,3 will be one charged positively and one charged negatively so as to assure a direct current flow therebetween. The welding current pulse will travel directly between the two closest points of said electrodes 2,3, so electrodes 2,3 must be positioned so that their closest points will be located where the ends of the light element 1 are desired. Preferably, the electrode 2,3 points will be on opposite sides of a depression 6, so the newly created elements 1 will span the depression 6. This method of light element 1 creation and attachment can be carried out without scraping off or leveling the layer of incandescent powder which is applied to the substrate 4. Producing light elements 1 by current pulse welding will create a light element 1 which is most solidly welded together along its core. It will have a uniformly rough surface area, approximately the same on all sides. Thus, light elements 1 created by current pulse welding will have a uniform brightness on all sides, unlike elements 1 created by laser welding. Light elements 1 of any size and shape, in filament or bead form, may be produced by either laser welding or by current pulse welding.

The present disclosure is primarily the disclosure of a basic new concept for designing, building, and manufacturing a new type of incandescent light emitting element and flat panel display. As can be seen, there may be an almost unlimited range of different design variations and possibilities. Although several variations are described herein, it is to be understood that other types may be produced in similar ways, which for convenience can not all be described herein. Also, details shown and described herein may be freely interchanged between the examples described in this disclosure as desired. All the details described in this disclosure are part of a larger basic concept, which it is hoped has been adequately described.

What is claimed is:

1. A flat panel electronic display screen comprising:

an electrically insulating substrate member;

an array of incandescent light-emitting microbeads disposed over an inner surface of said substrate member;

a plurality of row and column electrodes for selectively energizing said microbeads, each microbead being operatively associated with a pair of said row and column electrodes; and a transparent faceplate member overlying said microbeads and said substrate member to form a thin assembled display screen.

2. The display screen of claim 1 wherein said substrate member is formed with a plurality of concavities in the inner surface thereof disposed so as to underlie said microbeads.

3. The display screen of claim 2 wherein each said concavity is shaped to reflect light emitted by the respective overlying microbead in a preferentially forward direction from said substrate member.

4. The display screen of claim 3 wherein each said concavity is shaped to define a focal point and each respective overlying microbead is positioned at said focal point.

5. The display screen of claim 2 wherein said concavities are provided with light-reflective surfaces.

6. The display screen of claim 1 wherein said substrate member is transparent.

7. The display screen of claim 6 wherein said row and column electrodes are substantially transparent.

8. The display screen of claim 1 wherein said row and column electrodes are applied to the inner surface of said substrate member.

9. The display screen of claim 8 wherein said substrate member is formed with a plurality of concavities in the inner surface thereof disposed so as to underlie said microbeads, and said row and column electrodes define a plurality of pairs of row and column electrical contact points, a pair being positioned proximate to the rim of each said concavity with said inner surface and electrically connected to the respective overlying microbead.

10. The display screen of claim 1 wherein said row electrodes are substantially perpendicular to said column electrodes so as to define a plurality of crossover points and said row and column electrodes are electrically insulated from one another at said crossover points.

11. The display screen of claim 1, further comprising a plurality of pairs of row and column electrical contact points arrayed on the inner surface of said substrate member, each microbead being electrically connected with a pair of said contact points, and said row and column electrodes being disposed on a back surface of said substrate member opposite said inner surface and electrically communicating with said pairs of contact points through said substrate member for selectively energizing said microbeads.

12. The display screen of claim 11 wherein said electrical contact points are spaced above said inner surface.

13. The display screen of claim 11 wherein said substrate member is formed with a plurality of concavities in the inner surface thereof disposed so as to underlie said microbeads, and the row and column contact points of each said pair are positioned at the rim of a respective concavity with said inner surface at generally opposite points across said rim.

14. The display screen of claim 11, further comprising a plurality of electrically conducting posts penetrating through said substrate member and connecting said row and column electrodes with said pairs of contact points for effecting electrical communication therebetween.

15. The display screen of claim 1 wherein said faceplate member is formed with a plurality of concavities in an inner surface thereof disposed so as to overlie said plurality of microbeads.

16. The display screen of claim 15 wherein said substrate member is formed with a plurality of concavities in an inner surface thereof underlying said plurality of microbeads and in registration with the concavities in said faceplate member.

17. The display screen of claim 1, further comprising color filter means overlying a plurality of said microbeads.

18. The display screen of claim 17 wherein said color filter means is provided by a colored layer applied to an inner surface of said faceplate member.

19. The display screen of claim 18 wherein said colored layer is provided by a colored penetrating stain applied to the inner surface of said faceplate member.

20. The display screen of claim 17 wherein said microbeads form an array having a density sufficiently great for the display of a continuous image, and said color filter means further comprises first, second, and third primary color filter means overlying first, second, and third subarrays of said array of microbeads, said subarrays being arranged in a pattern for displaying a full-color image by selectively energizing microbeads of said subarrays.

21. The display screen of claim 20 wherein said first, second, and third primary color filter means are provided by colored layers extending over first, second, and third portions of the inner surface of said faceplate member according to said pattern.

22. The display screen of claim 20 wherein said face plate member is formed with a plurality of concavities disposed so as to overlie said microbeads, and said first, second, and third primary color filter means are provided by first, second, and third pluralities of discrete primary color filters, one such filter being disposed in each said concavity according to said pattern.

23. The display screen of claim 1, further comprising an optically transparent infrared-reflective coating applied to an inner surface of said faceplate member.

24. The display screen of claim 1, said display screen being driven by a circuit having a characteristic impedance, and said microbeads having an electrical resistance large compared with said characteristic impedance, thereby minimizing effects of fluctuations in the impedance of said circuit.

25. The display screen of claim 1, further comprising heat dissipation means in thermal contact with said faceplate member for controlling the temperature thereof.

26. The display screen of claim 1 wherein said microbeads have a generally prolate shape so as to resist mechanical shock and electrical burnout.

27. The display screen of claim 1 wherein said microbeads are formed with an irregular surface over at least a portion of the microbead surface area so as to exaggerate the light-emitting area and thereby enhance the brightness of said microbeads.

28. A flat panel electronic display screen comprising:

an electrically insulating substrate member;

an array of incandescent light-emitting microelements disposed over an inner surface of said substrate member in an array having a density sufficiently great for the display of a continuous image;

a plurality of row and column electrodes for selectively energizing said microelements, each microelement being operatively associated with a pair of said row and column electrodes;

first, second, and third primary color filter means overlying first, second, and third subarrays of said array of microelements, said subarrays being arranged in a pattern for displaying a full-color image by selectively energizing microelements of said subarrays; and a transparent faceplate member overlying said microelements and said substrate member to form a thin assembled display screen.

29. The display screen of claim 28 wherein said first, second, and third primary filter means are provided by colored layers extending over first, second, and third portions of an inner surface of said faceplate member according to said pattern.

30. The display screen of claim 28 wherein said faceplate member is formed with a plurality of concavities disposed so as to overlie said microelements, and said first, second, and third primary color filter means are provided by first, second, and third pluralities of discrete primary color filters, one such filter being disposed in each said concavity according to said pattern.

31. A flat panel electronic display screen comprising:

an electrically insulating substrate member formed with a plurality of concavities in a surface thereof;

a plurality of substantially uniform incandescent light-emitting microelements, each microelement being disposed at a concavity of said plurality;

a plurality of row and column electrodes for selectively energizing said microelements, said electrodes being arrayed on said surface of said substrate member in row and column directions running at least partially along the borders of said concavities with said substrate member surface so as not to block radiation emitted by said microelements or reflected from said concavities, and each said microelement being electrically connected with a pair of said row and column electrodes at the border of its respective concavity; and a transparent faceplate member overlying said microelements and said substrate member to form a thin assembled display screen, said faceplate member being formed with a plurality of concavities in the inner surface thereof in registration with the concavities of said substrate member.

32. The display screen of claim 31 wherein said microelements are provided by microbeads.

33. The display screen of claim of 31 wherein the concavities in said substrate member define an array of pixels having a density sufficiently great for the display of a continuous image.

34. The display screen of claim 33, further comprising barrier means providing a barrier between adjacent pixels of said array for preventing a microelement positioned at a first pixel from significantly illuminating pixels adjacent thereto.

35. The display screen of claim 34 wherein said microelements are provided by microbeads.

36. A flat panel electronic display screen comprising:

an electrically insulating substrate member formed of a heat resistant material with a plurality of concavities in a surface thereof, said concavities having a light-reflective and heat reflective surface;

a plurality of substantially uniform incandescent light emitting microbeads of a generally prolate shape sized to have a small physical and thermal mass, each microbead being disposed at a concavity of said substrate member and spaced apart therefrom so as to reduce heat transfer to said substrate member;

a transparent faceplate member overlying said substrate member, said faceplate member being formed of a heat resistant material with a plurality of concavities in the inner surface thereof in registration with the concavities of said substrate member, the concavities of said faceplate member having a heat-reflective surface, and said faceplate member being spaced apart from said substrate member so as to reduce heat transfer from said microbeads to said faceplate member;

wherein the concavities of said substrate member are shaped to reflect light emitted by said microbeads preferentially forward toward said faceplate member; and a plurality of row and column electrodes arranged to form an array of crossover points, said electrodes being disposed on said surface of said substrate member in row and column directions running at least partially along the borders of said concavities with said substrate member surface, each microbead being disposed proximate to, and electrically connect across, a respective crossover point for selective energizing thereof.

37. A flat panel electronic display screen for use in high-resolution display of moving images, comprising:

an electrically insulating substrate member defining a plurality of pixels on a surface thereof at a pixel density too great to be resolved by the human eye at intended viewing distances;

a plurality of incandescent light-emitting microelements disposed at said pixels, said microelements not exceeding the associated pixels in size and being formed with sufficiently low thermal inertia to be energized and de-energized at video rates for the display of moving images;

a plurality of row and column electrodes for selectively energizing said microelements, each microelement being operatively associated with a pair of said row and column electrodes; and a transparent faceplate member overlying said microelements and substrate member to form a thin assembled display screen.

38. The display screen of claim 37 wherein said pixels are provided with a light-reflective surface.

39. The display screen of claim 38 wherein said microelements are provided by microbeads.

40. The display screen of claim 39 wherein said microbeads have a generally prolate shape thereby to resist mechanical shock and electrical burnout.

41. The display screen of claim 37, further comprising first, second, and third primary color filter means overlying first, second, and third subarrays of said plurality of pixels and associated microelements, said subarrays being arranged in a pattern for displaying full-color images by selectively energizing microelements of said subarrays.

42. The display screen of claim 41 wherein said microelements are provided by microbeads.

* * * * *